United States Patent [19]

Glassman

[11] 3,967,331

[45] July 6, 1976

[54] SPRINGLESS BED SPRING

[75] Inventor: Arthur R. Glassman, Torrance, Calif.

[73] Assignee: De Lamar Bed Spring Corporation, Los Angeles, Calif.

[22] Filed: Apr. 17, 1975

[21] Appl. No.: 569,108

[52] U.S. Cl. ..... 5/236 R

[51] Int. Cl.[2] ..... A47C 23/06

[58] Field of Search ..... 5/236, 237, 191, 247, 5/255, 351, 238; 297/452; 267/1

[56] References Cited

UNITED STATES PATENTS

| | | | |
|---|---|---|---|
| 281,789 | 7/1883 | Pariseault | 5/236 |
| 488,378 | 12/1892 | Bell | 5/351 X |
| 871,871 | 11/1907 | Hirschman | 5/351 |
| 1,823,013 | 9/1931 | Wantz | 5/236 |
| 2,414,978 | 1/1947 | Richardson | 5/237 |
| 3,605,141 | 9/1971 | Silverman | 5/236 |

*Primary Examiner*—Paul R. Gilliam
*Assistant Examiner*—Andrew M. Calvert

[57] ABSTRACT

A springless box spring in which the flexural support is provided partly by a wooden frame assembly, partly by a wire mesh panel which is disposed upon and secured to the wooden frame assembly, and partially by a relatively thick insulating pad which rests upon the wire mesh panel.

1 Claim, 3 Drawing Figures

SPRINGLESS BED SPRING

BACKGROUND OF THE INVENTION

The design and manufacture of beds has become a highly diverse and highly sophisticated endeavor. Customers sometimes require a relatively hard bed for orthopedic reasons, or a conventional spring support, or perhaps the elusive type of support provided by a water bed. Cost considerations are also of crucial importance both to the customer and to the manufacturer.

The economics of manufacture changes at a steady pace. Some operations lend themselves to automated processes and hence become both less expensive in terms of cost and more reliable in terms of result. In other operations, however, the cost of a particular material may increase because of scarcity, or the relative cost of the required labor may increase at an unreasonable rate, or perhaps both.

The concept of the present invention is, basically, to defy tradition by providing flexural support without the use of springs. The object of the present invention is to provide a bed spring having an intermediate level of hardness, which can be manufactured and sold at low cost, and which may be used with considerable success either as the equivalent of a conventional bed spring or as part of an orthopedic bed.

SUMMARY OF THE INVENTION

According to the invention a springless sub-assembly for use in a bed spring consists of a rectangular wooden frame assembly and a wire mesh panel which is disposed upon and secured directly to the wooden frame. The wooden frame is preferably of the type that can be manufactured by automated equipment such as that shown in U.S. Pat. No. 3,606,130.

The wooden frame assembly is characterized by a number of wooden slats which are supported on their ends from a parallel pair of side pieces or end pieces. The slats are parallel with a spacing of at least several inches between them. The wire mesh panel includes spaced parallel longitudinal wires and spaced parallel transverse wires which are secured together as by welding at their crossover points. All of the wires extending in one direction are perpendicular to the wooden slats, and hence in conjunction with the slats provide a support for an insulating pad superimposed thereon, which would not be provided by the wooden frame assembly alone.

In a complete bed spring in accordance with the invention a relatively thick insulating pad is used, having a thickness of the order of one inch. The insulating pad may be placed directly on the wire mesh panel or upon an intervening flexible support member. The insulating pad is then covered with a cover sheet which also extends downward about the sides of the wooden frame and is secured to the frame.

DRAWING SUMMARY

BED SPRING SUPPORT SUB-ASSEMBLY

Figure 1:
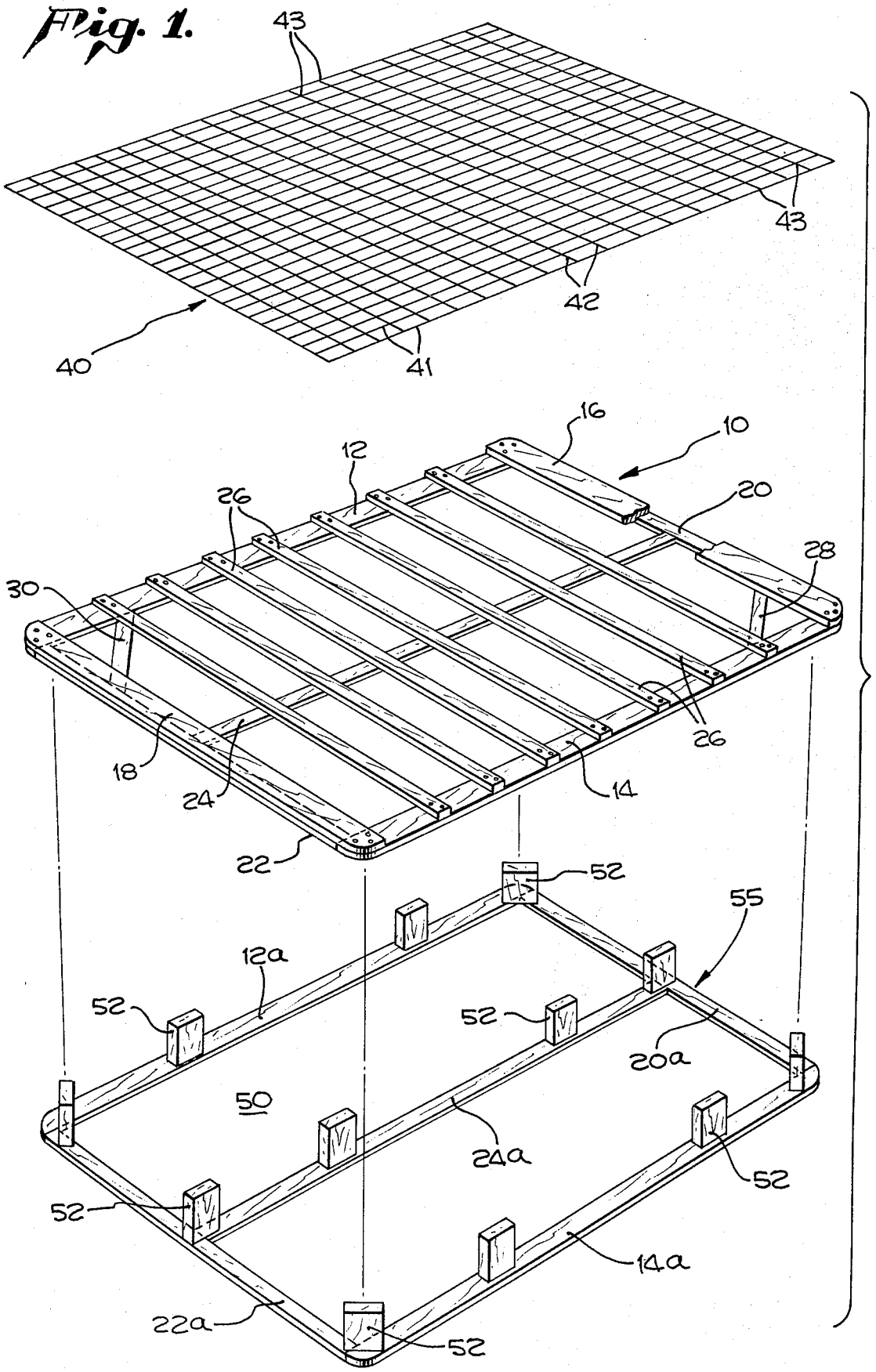
FIG. 1 is an exploded perspective view of a bed spring support sub-assembly in accordance with the invention.

Reference is now made to FIG. 1 illustrating the presently preferred form of the bed spring support sub-assembly in accordance with the invention. The complete support sub-assembly includes a wooden frame assembly 10 (center); a wire mesh panel 40 (top); and a support means 50 (bottom).

Wooden frame assembly 10 is identical to the assembly 10 shown in U.S. Pat. No. 3,606,130 and more particularly in FIGS. 2 and 47 of that patent. The reference numerals for its component parts as used in the present drawing are the same as those shown in the referenced patent. Thus, the wooden frame assembly 10 includes a parallel pair of side pieces 12, 14; parallel end pieces 20, 22 attached between the side pieces; and a center piece 24 which is in the same plane and attached to the end pieces. Also in the lower plane of the structure are corner braces 28, 30. Brace 28 is secured between the corners of side piece 14 and end piece 20 while brace 30 is secured between the corners of side piece 12 and end piece 22.

In the superstructure or upper layer of wooden frame assembly 10 there are a pair of end rounds 16, 18, and a plurality of cross-slats 26. Each of the end rounds overlies the associated end piece, and also has its ends extending over the side pieces 12, 14 and being securely nailed to the side pieces. Each end round also extends in a longitudinal direction internally of the frame from its associated end piece. In the present illustration there are seven of the slats 26, with a space of approximately seven inches between each pair of adjacent cross-slats or between one of the end rounds and its adjacent cross-slat. In accordance with the invention the wooden frame assembly 10 includes between a minimum of two slats and a maximum of about a dozen slats, depending upon the length of the bed in which the bed spring is to be used, and also depending on whether the slats are transverse or longitudinal.

The wooden frame assembly 10 has two important advantages which are fully utilized by the present invention. One advantage is that the frame assembly, being produced by automatic machinery is relatively inexpensive to manufacture. A second advantage is that the ends of the slats are secured to the side pieces by a relatively large number of nails which are firmly driven into place by an automatic machine, with their ends being turned over and firmly clinched. As a result, the suspended portions of the slats, lying between the side pieces 12, 14, will provide flexural support to a load which moves vertically, shifts about horizontally, and changes it magnitude, all without damage to the structure. In other words, the slats themselves provide a pretty good spring action.

Wire mesh panel 40 includes a number of longitudinal wires 41 and a number of transverse wires 42. The wires are secured at their crossover points 43, preferably by spot welding. In order to facilitate effective welding it is preferred to utilize a low-carbon wire, which therefore has essentially no spring quality.

In general, the spacing between adjacent parallel wires in the wire mesh panel 40 is of the order of 3 inches. It is greatly preferred that the spacing between the wires be less than the spacing between adjacent cross-slats 26, in order to provide a support for the pad that is superimposed upon the wire mesh panel, over and above the support that could be provided by the slats alone. In the presently preferred form of the invention the spacing between adjacent longitudinal wires 41 is about two inches while the spacing between adjacent transverse wires 42 is about 4 inches.

Supporting means 50 includes a plurality of wooden blocks 52 and a lower wooden frame 55. Lower frame 55 includes side pieces 12*a*, 14*a*, end pieces 20*a*, 22*a*, and center piece 24*a*, which are identical to their counterparts in the wooden frame assembly 10 and which are secured together in the same relative positions. There are preferably 12 of the wooden blocks 52, four of them being at the corners of the lower frame 55 and overlapping the adjoining side and end pieces. Two of the blocks are positioned above the junctures of center piece 24*a* with end pieces 20*a* and 22*a*. In addition, two of the blocks are superimposed on each of the longitudinal members, at the ¼ and ¾ length positions, respectively. The blocks 52 are preferably cut with their grain extending vertically.

Figure 2:
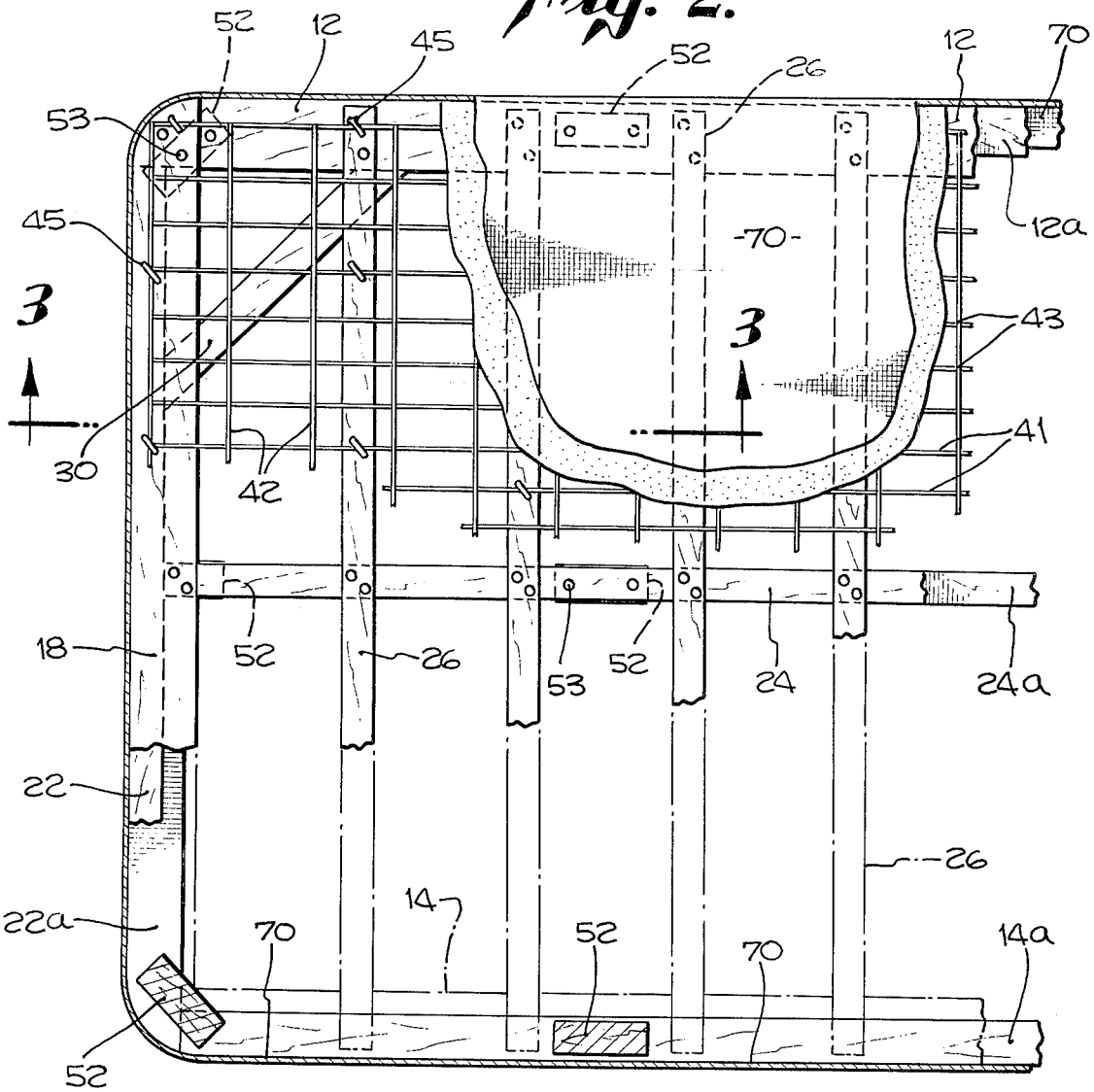
FIG. 2 is a top plan view, partially cut away, of a complete bed spring in accordance with the invention.
Figure 3:
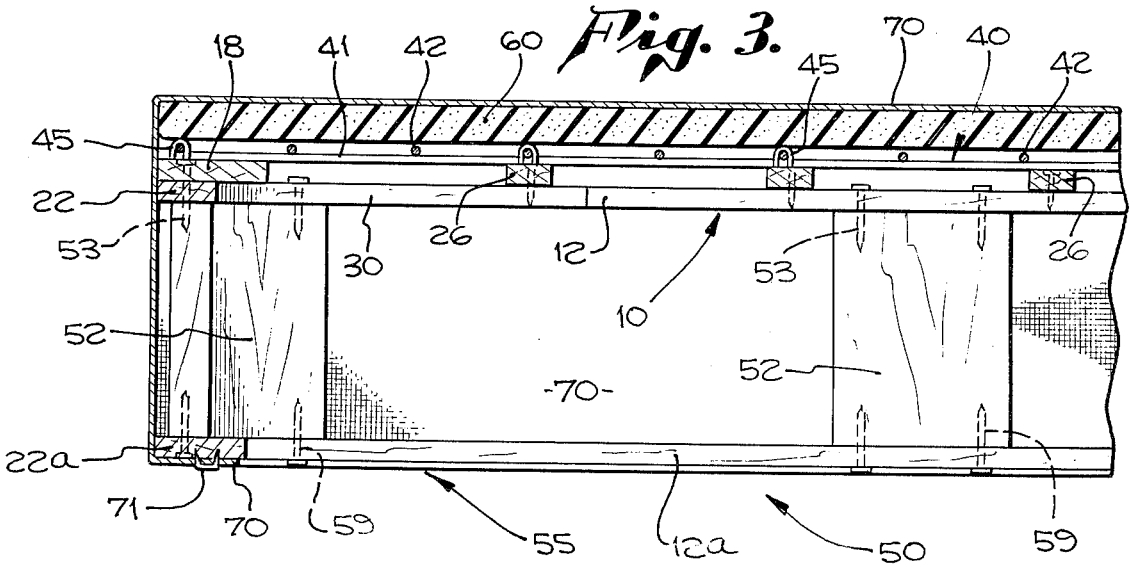
FIG. 3 is a cross-sectional elevational view of the bed spring taken on line 3—3 of FIG. 2.

Reference is made to FIGS. 2 and 3 which illustrate the manner in which the support sub-assembly of FIG. 1 is assembled together. Thus the bottom ends of wooden blocks 52 are fastened to the lower frame 55 by nails 59. The upper ends of blocks 52 are fastened to the lower portion of wooden frame assembly 10 (side pieces 12, 14, end pieces 20, 22 and center piece 24) by nails 53. Wire mesh panel 40 is fastened directly to the upper surface of the frame 10 by a plurality of staples 45. Some of the staples 45 are driven into the end rounds 16, 18 and others are driven into the cross-slats 26.

COMPLETE BOX SPRING

A complete box spring in accordance with the invention is illustrated in FIGS. 2 and 3. A relatively thick insulating pad 60 is placed directly upon the wire mesh panel 40. Insulating pad 60 may be made of any suitable type of material, such as Polyfoam which is a foam plastic polyurethane product, or garnetted cotton which is felted and compressed into a pad, or Tuflex which is wood pulp that is ground up with resin added.

The complete box spring also includes a cover sheet 70 which may be any conventional type of mattress ticking cover. The cover sheet 70 extends over the upper surface of insulating pad 60, down around the sides of the wire mesh panel 40 and wooden frame assembly 10, and hence down around and underneath the edges of the support means 50. Staples 71 are used to fasten the cover sheet 70 to the under surface of lower frame 55.

ALTERNATE FORMS

The support means 50 may be lengthened, shortened, or omitted altogether, depending upon the design of the bed in which the bed spring is to be used. When a presently conventional bed frame is to be used the height of the blocks 52 is about six inches, thus compensating for the space which would otherwise have been occupied by conventional coil springs. In bunkbeds and the like, however, it is preferred to omit the support means 50 altogether, having the side pieces 12, 14 supported directly by the bed frame.

In the complete bed spring it may be preferred to utilize a flexible support member between the wire mesh panel 40 and the insulating pad 60. For example, a layer of cardboard may be used, or a nylon netting, or the like, which will protect the insulating pad from damage or from loss of component material.

While a particular form of the wooden frame assembly has been illustrated, the invention is applicable to any frame structure having parallel slats which are supported on their ends. The slats may extend transversely as shown, and be supported by side pieces of the frame, or they may extend longitudinally and be supported by end pieces of the frame.

The invention has been described in considerable detail in order to comply with the patent laws by providing a full public disclosure of at least one of its forms. However, such detailed description is not intended in any way to limit the broad features or principles of the invention, or the scope of patent monopoly to be granted.

What is claimed is:

1. In a box spring, the sub-assembly comprising:

a rigid upper rectangular wooden frame assembly having parallel side pieces and a plurality of slats disposed in spaced parallel relationship upon said side pieces, the ends of said slats being secured to respective ones of said side pieces;

a lower rectangular wooden frame;

a wire mesh panel which is substantially coextensive with said upper wooden frame, being disposed upon said slats, said wire mesh panel including spaced parallel longitudinal wires and spaced parallel transverse wires, the spacing between adjacent ones of said parallel wires being less than the spacing between adjacent ones of said slats;

a plurality of fasteners in spaced locations on said wire mesh panel and securing corresponding wire portions thereof to the respectively adjacent upper surface portions of said wooden slats;

whereby a relatively thick insulating pad may be placed upon said wire mesh panel for providing a box spring assembly; and and a plurality of vertically extending wooden blocks attached to the underside of said upper frame and extending downwardly therefrom to said lower frame, whereby said upper frame is rigidly supported in elevated relationship to said lower frame.

* * * * *